US005104522A

United States Patent [19]

Crosby et al.

[11] Patent Number: 5,104,522

[45] Date of Patent: Apr. 14, 1992

[54] SPRAY FRACTIONATION DISKS AND METHOD OF USING THE SAME

[75] Inventors: Edwin J. Crosby, Madison, Wis.; Rustam H. Sethna, Scotch Plain, N.J.; Anil R. Oroskar, Downers Grove, Ill.

[73] Assignee: Wisconsin Alumni Research Foundation, Madison, Wis.

[21] Appl. No.: 522,379

[22] Filed: May 9, 1990

[51] Int. Cl.[5] ..... B03B 5/58

[52] U.S. Cl. ..... 209/210; 209/208; 209/642; 494/43

[58] Field of Search ..... 209/208, 210, 638, 641, 209/642, 645, 691, 695; 366/155, 169; 494/43

[56] References Cited

U.S. PATENT DOCUMENTS

| | | | |
|---|---|---|---|
| 472,682 | 4/1892 | Pape et al. . | |
| 653,792 | 7/1900 | Dasconaguerre | 209/642 |
| 1,064,579 | 6/1913 | Wennberg | 494/43 |
| 1,358,375 | 11/1920 | Koch . | |
| 1,517,509 | 3/1922 | Hokanson . | |
| 1,853,249 | 4/1932 | Ainlay | 494/43 |
| 2,224,169 | 8/1938 | Turnbull | 209/12 |
| 3,276,591 | 10/1963 | Hultsch | 210/213 |
| 3,326,459 | 10/1964 | Leroux | 233/28 |
| 3,485,360 | 8/1967 | Deinken et al. | 209/117 |
| 3,591,000 | 7/1971 | Humphreys | 209/210 |
| 3,819,110 | 6/1974 | Baturov et al. | 233/17 |
| 4,288,317 | 9/1981 | de Ruvo et al. | 209/139 A |
| 4,427,541 | 1/1984 | Crosby et al. | 209/210 |
| 4,793,917 | 12/1988 | Eremin et al. | 209/148 X |
| 4,798,577 | 1/1989 | Brenneman et al. | 494/43 X |

FOREIGN PATENT DOCUMENTS

| | | |
|---|---|---|
| 49-83663 | 7/1974 | Japan . |
| 216210 | 10/1967 | Sweden . |

OTHER PUBLICATIONS

Soviet Inventions Illustrated, Derwent Publications Ltd., London, GB, Section Chemical/General Week E44, Abstract No. 82-94771E, Classes JO2 P41, Dec. 15, 1982, and Soviet Union patent document SU-A-895571 [A.N. Dubovets et al.].

Chemie. Ingenieur Technik., vol. 37, No. 12, Dec. 1965, Weinheim De, pp. 1221-1223, A. Kober et al., "Trennung Durch Adhasion-Ein Neues Verfahren Zum Nassklassieren".

Patent Cooperation Treaty published application WO-A-8 404258, published Nov. 8, 1984.

Felsvang et al., "Screening, Cleaning and Fractionation with a Rotating Cup Atomizer", 17th EUCEPA Conf., Vienna, Austria, Oct. 10-14, 1977.

Moller et al., "Screening, Cleaning and Fractionation with an Atomizer", Paper Technology and Industry, vol. 20(3), Apr. 1979, pp. 110-114.

Moller et al., "High-Consistency Pulp Fractionation with an Atomizer", TAPPI, Sep. 1980, vol. 63, No. 9, pp. 89-91.

(List continued on next page.)

*Primary Examiner*—Donald T. Hajec
*Assistant Examiner*—Joseph A. Kaufman
*Attorney, Agent, or Firm*—Foley & Lardner

[57] ABSTRACT

Fractionation apparatus utilizes a rapidly rotating disk which receives a suspension of particles to be separated in a liquid. The rotating disk has a planar floor onto which the particle containing liquid is supplied. The floor is joined to an inclined inner wall in a smooth curve. An axially symmetric trip, located between the inner wall and an outwardly extending, preferably upwardly inclined skirt, maintains particles in the film away from the surface of the disk and results in more efficient ejection of large particles from the liquid. Smaller particles are ejected from the disk along the rim which descends from the skirt or from the edge at which the skirt joins the rim. The characteristics of the disk surface, the disk speed, the size and number of trips, the suspension feed rate, and other operating conditions can be selected such that highly efficient fractionations of particle suspensions, such as wood pulp slurries, can be obtained.

35 Claims, 5 Drawing Sheets

OTHER PUBLICATIONS

Oroskar et al., "Fiber Separation with a Vaneless Spinning Disk: Determination of Mechanism", 1983, Pulping Conference, TAPPI Proceedings, pp. 673–677.
Klungness et al., "Fiber Separation with a Vaneless Spinning Disk: Application", 1983 Pulping Conference, TAPPI Proceedings, pp. 679–683.
Klungness et al., "Fiber Separation with a Vaneless Spinning Disk: Application", TAPPI Journal, vol. 67, No. 6, Jun. 1984, pp. 78–81.
Oroskar et al., "Vaneless Disk Fractionation of Slurries", Ind. & Eng. Chem. Fundam., vol. 25, No. 4, ±986, pp. 483–490.
Anil Rajaram Oroskar, PhD. Theis, University of Wisconsin–Madison, 1981, entitled "Spray Fractionation".

36
38

80
81
82
83
86
85

66
66
64

70
71
72
73
76
75

SPRAY FRACTIONATION DISKS AND METHOD OF USING THE SAME

TECHNICAL FIELD

This invention relates generally to the field of apparatus and techniques for separating particles within a liquid carrier, such as fibers in a pulp slurry, according to the relative sizes and other characteristics of the particles, and relates particularly to fractionation disks for such apparatus.

BACKGROUND OF THE INVENTION

Processes for separating small particles contained in a suspension or slurry by size, wettability and other characteristics find application in various industries. The ability to make such separations is particularly desirable in paper making since the thickness and length of the pulp fibers are strongly related to the quality and characteristics of the paper produced from the fibers. Several specific potential uses in the paper industry for efficient fractionation processes have been identified.

A pulp slurry formed of reclaimed waste paper or paper board may be fractionated to remove clumps and particulate contaminants, and to separate fibers above and below a desired size. For example, such fractionation would allow the "linerboard" fibers in a slurry of waste corrugated fiberboard to be separated from the "medium fibers." Linerboard is mainly composed of softwood fibers of relatively large size (40–50 microns diameter, 3–5 mm length) whereas medium fibers are mainly hardwood fibers of smaller size (20–30 microns diameter, 1–3 mm length).

Fractionation also would allow a single fiber source, which ordinarily is a mix of fibers of various sizes, to be used optimally in the production of a desired multi-layered product. Each fraction, separated by fiber size, could be used to form a single layer which would have characteristics reflecting the size of the fibers in the layer. The layers of different fractions would then be combined to form a multi-layered product with qualities not possessed by a single layer product formed from the original fiber mix.

The separated pulp fractions also could be used alone to make single layer products having desired characteristics related to fiber size. In addition, some papermaking machines operate most efficiently with pulp having a particular fiber size range. Another potential application of pulp fractionation is the separation of a pulp stream into two or more fractions which can be beaten separately under optimium conditions and then recombined.

The fractionation apparatus disclosed in U.S. Pat. No. 4,427,541, the disclosure of which is incorporated herein by reference, has been shown to be highly effective in fractionating a slurry of fibers of varying diameter. This apparatus comprises a disk which is symmetrical about an axis of rotation with a face adapted to stabilize the film of the slurry deposited on the face, which terminates in a sharp, circular peripheral face edge. A descending rim or skirt extends from the face edge and terminates in a peripheral edge. This disk--which may have a planar face or an evenly concave or convex face--is rotated about a vertical axis. When the face and skirt of the disk are wettable and the particulate slurry is supplied to the face, coarse and/or poorly wettable particles are found to detach themselves from the flowing slurry film in a dewatered state and to move radially from the face edge and upper portion of the skirt in a relatively narrow band, while the fines are carried by the flowing liquid film over the surface of the skirt and disengaged, with the film, along the lower portion of the skirt or at the peripheral edge of the skirt. A separator wall may be positioned adjacent the rim to separate physically the two fractions of spray ejected from the disk, one carrying the coarse particles and the other the fines.

The chief limitation on the flow capacity of such an apparatus for fractionating a particle slurry is the extent to which the film stability can be maintained on the surface of the disk and break-up of the film prevented.

SUMMARY OF THE INVENTION

In accordance with the present invention, good quality fractionations of particle suspensions at greatly increased flow rates of slurry are obtained utilizing a rotating fractionation disk having a shallow bowl configuration with a horizontal or preferably an upwardly inclined skirt. By providing properly radiused corners and properly oriented surfaces for the disk and by including one or more inset steps or trips on the disk wall near the skirt, high throughput fractionation for a wide range of fiber diameter, density, or wettability is obtainable.

The fractionation disk preferably has disk body with a planar floor and an inclined inner wall which extends upwardly from the perimeter of the floor and terminates in a sharp, axially symmetric lower trip edge. An axially symmetric trip extends from the trip edge and has a substantially outwardly extending portion and an inclined vertical portion which terminates in a sharp upper trip edge. A skirt extends outwardly, and is preferably inclined upwardly, from the upper edge of the trip and terminates at a peripheral edge. A substantially vertical rim descends from the edge of the skirt. The floor, wall, trip, and skirt of the disk are wettable and adapted to allow a stable film of the liquid carrying the particles to form thereon. When such a disk is rotated and supplied with a particle slurry to its face, a distinct separation of particles will occur in the space surrounding the disk in accordance with the factors set forth in the aforesaid U.S. Pat. No. 4,427,541. In particular, the largest or coarse particles are found to detach themselves from the flowing slurry film at the trip and along the inner portion of the skirt, while the fines are carried by the flowing liquid film over the surface of the skirt and are ejected at the outer edge of the skirt, along the rim, or at the rim edge, with the liquid film. The separation takes place in apparent correlation with particle diameter for elongated particles, such as wood fibers. Such discrimination in particle size allows separation of fibers by length, if fiber length is directly related to fiber diameter, as is generally the case for wood pulp. In particular, clumps of large fibers, shives, and relatively large foreign particles, such as sand, and particles less wettable than pulp fibers, are substantially separated from the fine particles in such wood pulp slurries.

In the preferred apparatus for carrying out the invention, the rotating disk has a trip with an outwardly extending trip width of about 1/32 inch and an inclined trip length of less than the maximum fiber migration distance. The skirt is preferably inclined upwardly at an angle of about 5 degrees. By selecting the diameter, edge radii, trip dimensions, and rotational speed of the disk, it is possible to split a pulp slurry into two components having selected characteristics, such as sizes above or below a chosen fiber diameter. By successive passes of a fiber furnish through an apparatus of the type described, it is possible to separate an initial fiber furnish into components which contain substantially only fibers within a preselected size range.

The shallow bowl-like disk surface permits a film of greater thickness to be formed thereon than on a disk in accordance with the prior art. The efficiency of a fractionation disk will fall off dramatically when the diameter of the particles to be fractionated is greater than the thickness of the slurry film on the disk. Thus, the bowl-like disk can permit effective fractionation of larger diameter fibers than was previously practical.

The trip or trips serve to keep the fibers away from the wall in the area near the intersection of the wall and skirt, thus minimizing loss of the fiber velocity due to friction between the wall and the fiber. A greater proportion of the larger fibers will thus attain ejection velocity at the edge where the skirt begins, thereby improving fractionation efficiency over a disk which does not have a trip.

Further objects, features and advantages of the invention will be apparent from the following detailed description taken in conjunction with the accompanying drawings showing a preferred embodiment of apparatus for carrying out spray fractionation in accordance with the invention.

DETAILED DESCRIPTION OF THE INVENTION

Figure 1:
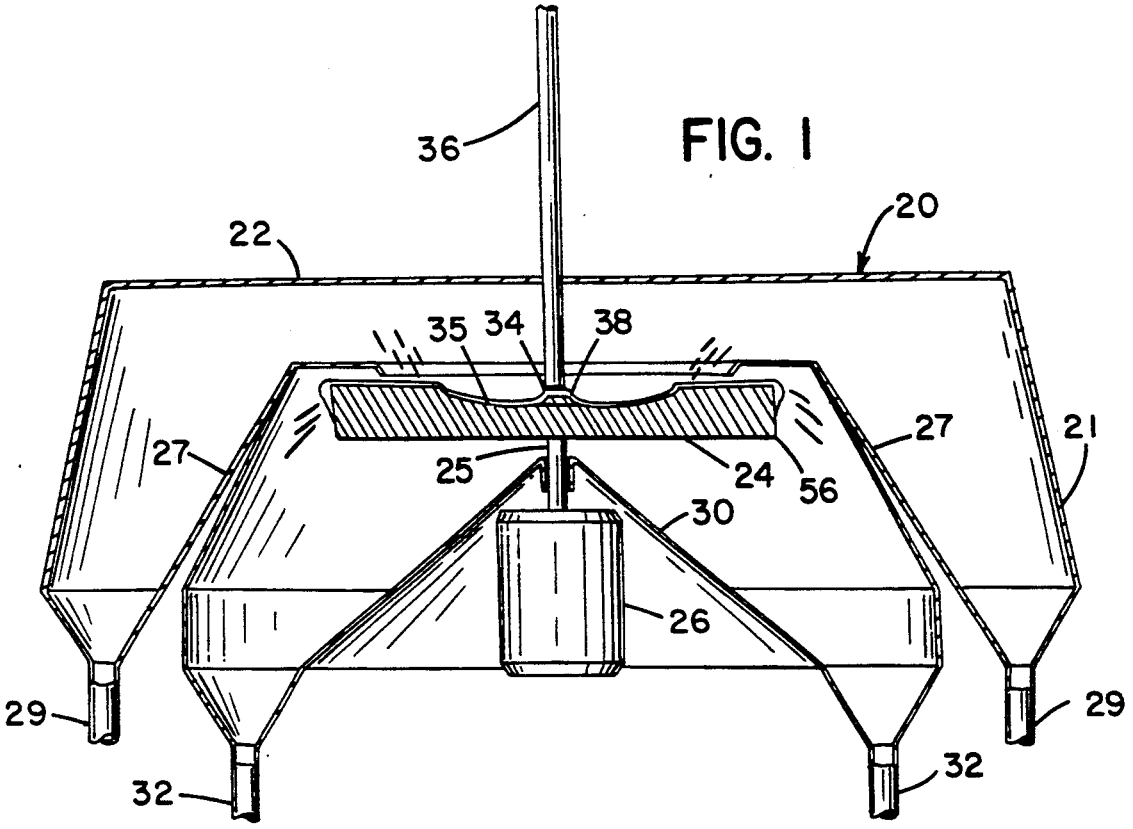
FIG. 1 is a simplified cross-sectional view of a spray collector chamber enclosure with a rotating fractionation disk mounted therein illustratively showing streams of particles and liquids being collected.

With reference to the drawings, a simplified sectional view of fractionation apparatus in accordance with the invention is shown generally at 20 in FIG. 1. A generally cylindrical outer enclosure wall 21 and a top enclosure wall 22 surround and close off from the atmosphere a shallow bowl-type fractionation disk 24 having a solid, preferably metal body which is mounted for rotation about a vertical axis on a shaft 25 driven by an electric motor 26. The disk 24 is formed of a preferably solid body and is symmetric about the axis on which it rotates (the "axis of rotation"). A truncated cone shaped separator wall 27 is mounted within the collector defined by the outer wall 21 and the inner wall 30 to separate the collector into two chambers. A first chamber or sump, defined between the separator wall 27 and the conical inner wall 30, collects the smaller fibers along with most of the water. The water and fiber slurry collected in the sump is drained out through sump outlet pipes 32. The second lower chamber, defined between the separator wall 27 and the outer wall 21, collects large, substantially dewatered fibers, which are discharged through outlet pipes 29.

The feedstock 34, a suspension or slurry of particles in water or other liquid, is supplied to the center of the face 35 of the disk 24 through a supply outlet pipe 36 which discharges the slurry onto the disk 24 just above the center of the face. Bottom feed arrangements may also be used, in which case the slurry is supplied to the center of the face of an inverted disk through a supply outlet pipe which discharges the slurry upwardly onto the inverted disk just beneath the center of the face. The face 35 is formed on the side of the disk opposite that to which the shaft 25 is attached, so that the shaft 25 will not interrupt the face 35. A cone 38 is preferably mounted at the center of the disk face 35 to aid in the even distribution of the slurry as it impacts on the disk face. For reasons further explained below, it is desirable for the face to be as well adapted as possible to allow a stable film of liquid to form thereon. The feedstock is pumped to the supply outlet from a tank using standard equipment (not shown).

Figure 2:
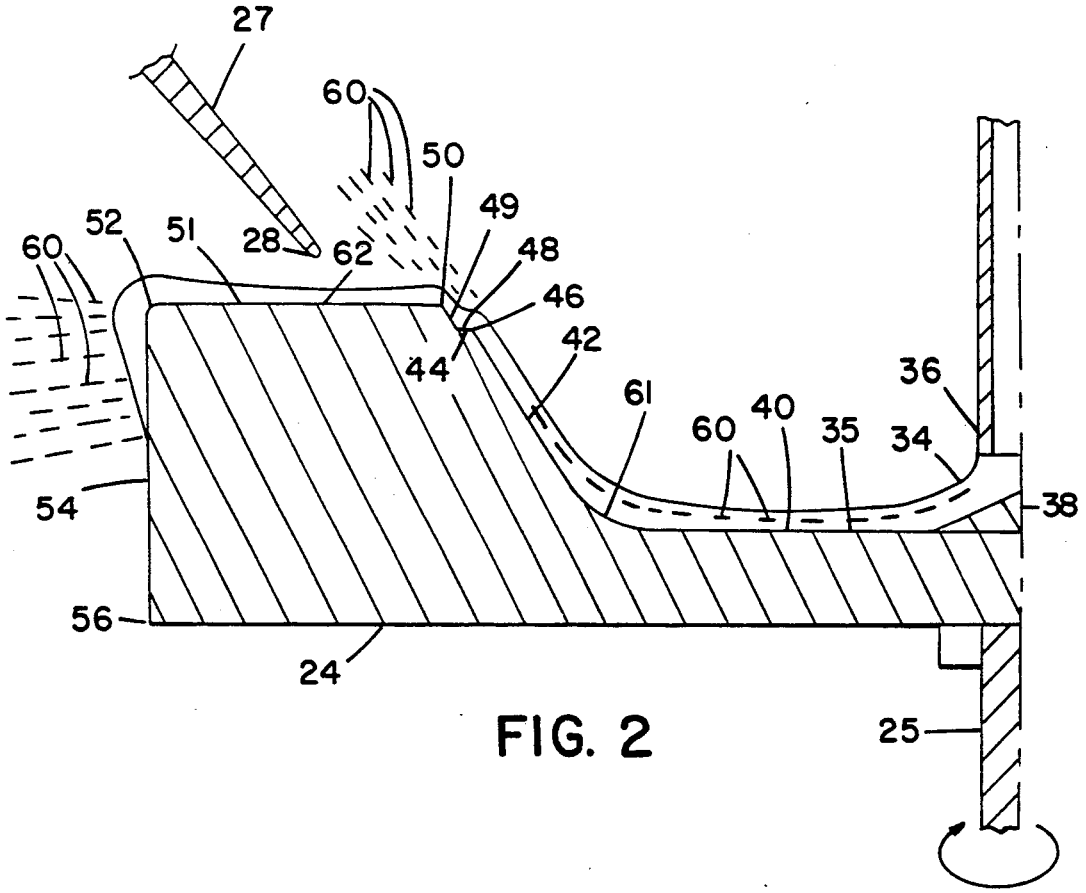
FIG. 2 is a radial cross-sectional view of a portion of a rotating disk illustratively showing the liquid film formed on the disk and the ejected particles.
Figure 3:
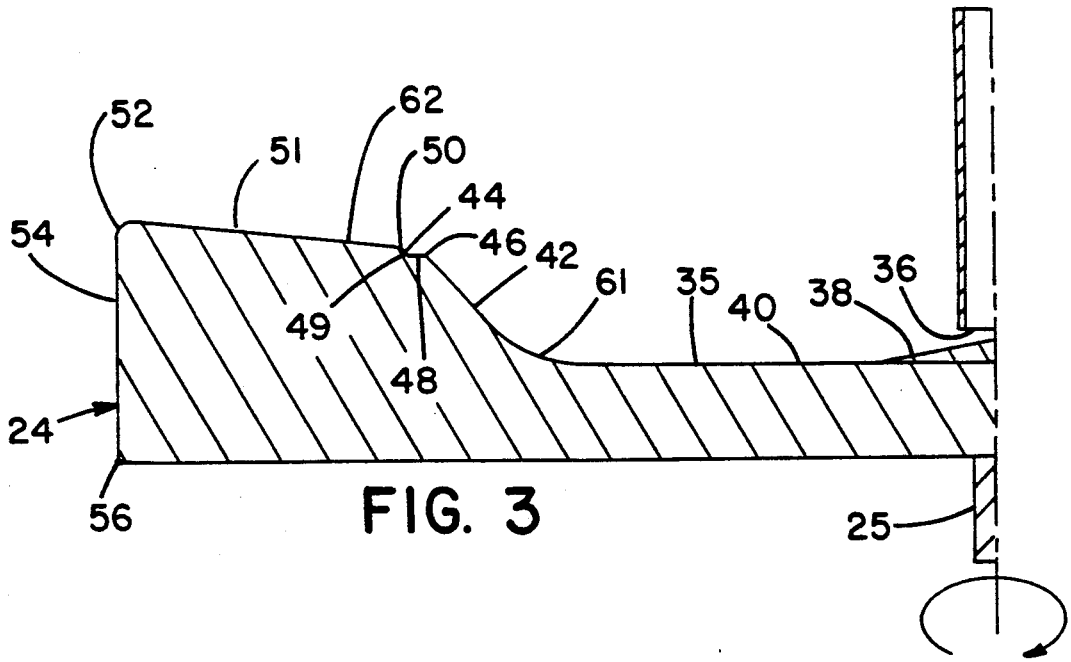
FIG. 3 is a radial cross section of an embodiment of a disk having a single trip.

As best shown in FIG. 2, the body of the disk 24 has a planar floor 40, with an inclined inner wall 42 extending upwardly away from the perimeter of the floor 40. The inner wall 42 is joined to the floor preferably by a smoothly curved region 61. The inner wall 42 terminates in a sharp axially symmetric (circular) lower trip edge 46. An axially symmetric trip 44, with an outwardly extending (substantially horizontal) portion 48 and an inclined upwardly extending (vertical) portion 49 extends from the lower trip edge 46. For purposes of clarity and simplicity of explanation, "horizontal", as used herein, refers to a direction lying in a plane normal to the axis of rotation of the disk, and "vertical" refers to a direction parallel to the axis of rotation. "Upwardly extending" refers to a direction away from the axis of rotation generally (but not necessarily exactly) vertically away from the floor of the disk, and "outwardly extending" refers to a direction generally (but not necessarily exactly) horizontal. The trip 44 terminates in a sharp upper trip edge 50. A skirt 51 extends outwardly from the upper trip edge 50 (the skirt 51 shown in FIG. 2 is essentially horizontal) and terminates at a peripheral edge 52. A substantially vertical rim 54 descends from the peripheral edge 52 of the skirt and terminates in a rim edge 56.

As explained further below, the suspension of particles in liquid forms a film on the rotating face surface 35 which moves to the peripheral edge 52. As illustrated in FIG. 2, the larger and/or less wettable particles tend to break the surface of the film at the trip edges 46, 50 and along the skirt 51 and are ejected from the disk, while the smaller and/or more wettable particles remain in the film which turns over the edge 52 and pass downwardly along the rim 54 of the disk until the film with suspended particles either becomes unstable and detaches or reaches the rim edge 56, where both liquid and particles are ejected. The water and smaller particles are collected in the first collector chamber, between the separator wall 27 and the inner wall 30, and the larger particles are collected in the second collector chamber between the separator wall 27 and the outer wall 21. Because the larger particles within the second chamber generally will have very little water associated with them, it may be desirable under some circumstances to provide a water spray within the second chamber to wash the larger particles down into the outlets 29.

More detailed views of embodiments of the rotating disk used in the spray fractionation apparatus 20 are shown in FIGS. 2–8 and 11, it being understood that each of the embodiments shown in these figures may be substituted for the disk 24 illustrated in FIG. 1.

The body of the disk 24 can be formed of aluminium or suitable grades of steel (preferably stainless) with the surfaces (40, 42, 51, 61, 62) of the face 35 being polished to minimize fiber friction upon contact and having maximum wettability to impart maximum acceleration to the slurry provided through the supply outlet 36.

The feedrate of the feedstock and the speed of disk rotation affect the cut-size between large and small diameter fibers which are separated by the disks.

The mechanism of fiber disengagement from a rotating disk can be understood in terms of the inertia of a fiber at a particular point on the disk surface and the counteracting restraining surface forces exerted on the fiber. When the kinetic energy of a particle is greater than the restraining surface energy, the particle will detach from the film. Larger diameter fibers will have greater kinetic energy than smaller diameter fibers of comparable density, and will thus be ejected first.

The prior disks, because of the tendency of the film to become unstable and break up along the disk skirt, are limited in the slurry flow rates that can be handled. For example, a disk of 6 inch diameter having a 45 degree skirt and rotating at 3800 rpm, can usually not handle slurry flow rates much greater than 6 pounds-mass per minute. Using the fractionation disk of the present invention, effective fractionation of the fiber slurry can take place at flow rates of about 40 pounds-mass per minute, as illustrated in the experimental results given below.

When the feedstock 34 is directed onto the face 35 of the rotating disk 24 through the supply outlet 36, a film 58 forms on the face 35. The slurry feedstock 34 makes contact with the disk face 35 at the center of the disk. On contact with the disk, the fibers and film accelerate along the planar floor 40 to the base of the inner wall 42. At the inner wall 42, which is inclined upwardly, fibers will tend to migrate in the film to the surface of the disk 24. This migration is caused by inertial effects which may be augmented by centrifugal effects. When fibers 60 make contact with the surface of the disk 24, friction between the disk and the fibers results in decreased speeds of the fibers. To minimize the migration of the fibers toward the disk surface, the radius of curvature of the disk face 35 at the intersection 61 where the inclined inner wall 42 meets the floor 40 should be sufficiently large, e.g., on the order of 2 cm. However, some migration of the fibers cannot be avoided.

Figure 4:
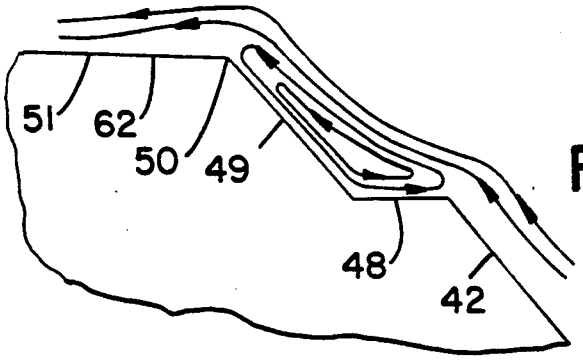
FIG. 4 is a more detailed view of a particular sized trip for a disk of the type of FIG. 2 schematically showing the fluid flow when the slurry is applied to the rotating disk.
Figure 5:
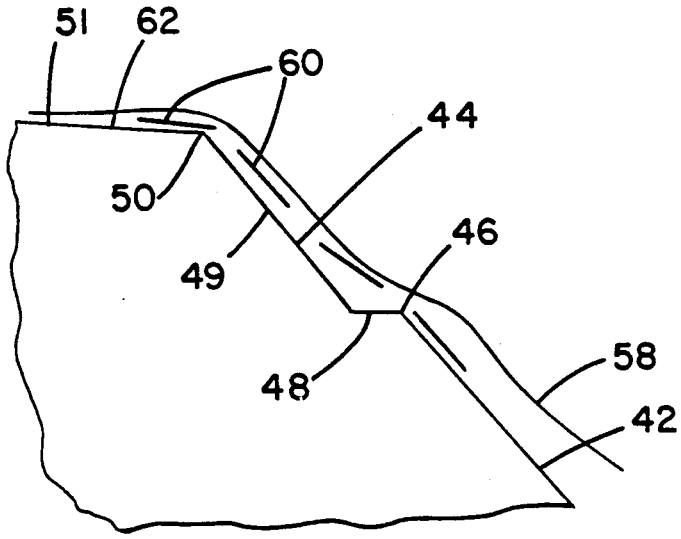
FIG. 5 is a schematic view of a particular sized trip for a disk of the type of FIG. 2 illustratively showing the alignment of particles in the film slurry when the disk is rotated.

The disks may be formed such that the inner wall 42 meets the skirt 51 directly, with larger fibers being ejected from the disk at the intersection of the skirt 51 and the inner wall 42. Although significant fractionation occurs, because of the loss of fiber velocity to friction with the inner wall a proportion of large fibers will not be ejected. It has been found that the problem of centrifugal migration of the large diameter fibers and its detrimental effect on fractionation can be overcome by supplying a trip structure on the disk that keeps the fibers away from the wall. The trip 44 shown in FIG. 2 consists of a small step in the upwardly sloping inner wall 42 where it meets the skirt 51. FIG. 4 illustrates the fluid motion within the trip 44 for a relatively wide trip. FIG. 5 illustrates how the fibers 60 are held away from the wall within the film at the trip structure with a trip having somewhat shorter width. The inertia associated with a fiber causes it to try to continue to move in the same direction. Consequently, those fibers which have attained a velocity sufficient to be ejected from the film will tend to burst through the film at the lower trip edge 46. The other large fibers will tend to be directed by the trip back toward the outer surface of the film where they are no longer retarded by friction at the wall and are thus allowed to attain ejection velocity so that they may be detached from the film at the upper trip edge 50 or close to the trip edge along the skirt 51.

The effectiveness of a single trip to preclude fiber migration depends on the sharpness of the lower trip edge 46, the length of the horizontal portion 48 (the width of the trip), and the length of the inclined vertical portion 49. From theoretical studies of the action of fiber slurry films on a spinning disk, it has been determined that, for effective fractionation and particle ejection at the lower trip edge 46, the radius of curvature of the lower trip edge 46 should be small enough so that $$\beta = \rho p \frac{\pi}{4}\left\{\frac{d_p^2 V_c^2 \tan\theta}{[R_T(1-\cos\theta)+\delta]}\right\}\left\{\frac{\sin\theta}{\gamma\cos\alpha}\right\} \geqq 50$$

Where $\beta$=effectiveness factor $\rho_p$=particle density $d_p$=diameter of cylindrical fiber or spherical partical $V_c$=critical disengagement velocity of fiber $R_T$=radius of curvature of trip edge $\theta$=inner wall angle (rad)

$\gamma$=surface tension of liquid $\alpha$=contact angle between fiber and liquid $\delta$=slurry film thickness If $\beta$ is less than or equal to 1 the trip will have no effect on the fiber motion. However, the radius of curvature of the lower and upper trip edges 46 and 50 should be large enough to ensure that severe film instabilities do not occur in the region of the trip 44. For many conditions, a radius of curvature of 1/64 inch has been found to be optimal. A smaller radius would tend to result in film instabilites while a larger radius is not as efficient.

The width of the horizontal portion 48 of the trip 44 has an important effect on the motion of the fibers. If the width of the horizontal portion 48 is sufficiently long, e.g., on the order of the length of the fibers 60, the fibers are likely to be impelled toward the inclined vertical portion 49 of the trip 44. However, if the width of the horizontal portion 48 is on the order of a few film thicknesses the fibers will tend to move as shown in FIG. 5. Trip widths of 1/16 and 1/32 inch have been found to be effective, with the smaller width being the more effective.

The length of the inclined vertical portion 49 will also determine the effectiveness of the trip 44. Experimental and theoretical considerations have shown that the length of the inclined vertical portion 49 should be less than the maximum fiber migration distance as determined by the expression:

$$h = \frac{8\,Q\mu}{\pi\, d_p^2\, \Delta\rho\omega^2\, R^2}\left[\ln\left(\frac{L}{d_p}\right) + 1.19\right]$$

where h=maximum fiber migration distance
Q=volumetric flow rate of slurry
$\mu$=fluid viscosity
$d_p$=diameter of cylindrical fiber or spherical particle
$\Delta_p$=(density of particle−density of liquid)
$\omega$=rotational speed of disk
R=radius of disk interior flat surface
L=length of cylindrical fiber Larger fibers also detach themselves from the liquid film at the ejection zone 62 on the skirt 51. The skirt 51 extends radially outwardly from the upper trip edge 50 a convenient distance to maximize physical separation of the particle streams ejected near the inner and outer edges of the skirt, for example, in the range of 1 to 2 cm.

After the larger or less wettable fibers have been ejected from the film 58, the film continues to flow outwardly along the skirt 51. The film may turn over the peripheral skirt edge 52 and may run along the rim 54. At the outer skirt edge 52, at the rim, or at the rim edge 56, the smaller fibers and the liquid will be ejected. The physical gap between the streams of large and small particles has generally been found to be widest when the skirt 51 is inclined at approximately 5 degrees upwardly from the horizontal. As illustrated in FIG. 2, it is preferred that the inner-most edge 28 of the separator wall 27 be closely adjacent to the skirt 51 at a position between the upper trip edge 50 (the inner edge of the skirt) and the peripheral edge 52 of the skirt to maximize physical separation of the two streams of material ejected from the disk.

Figures 6, 7, 8:
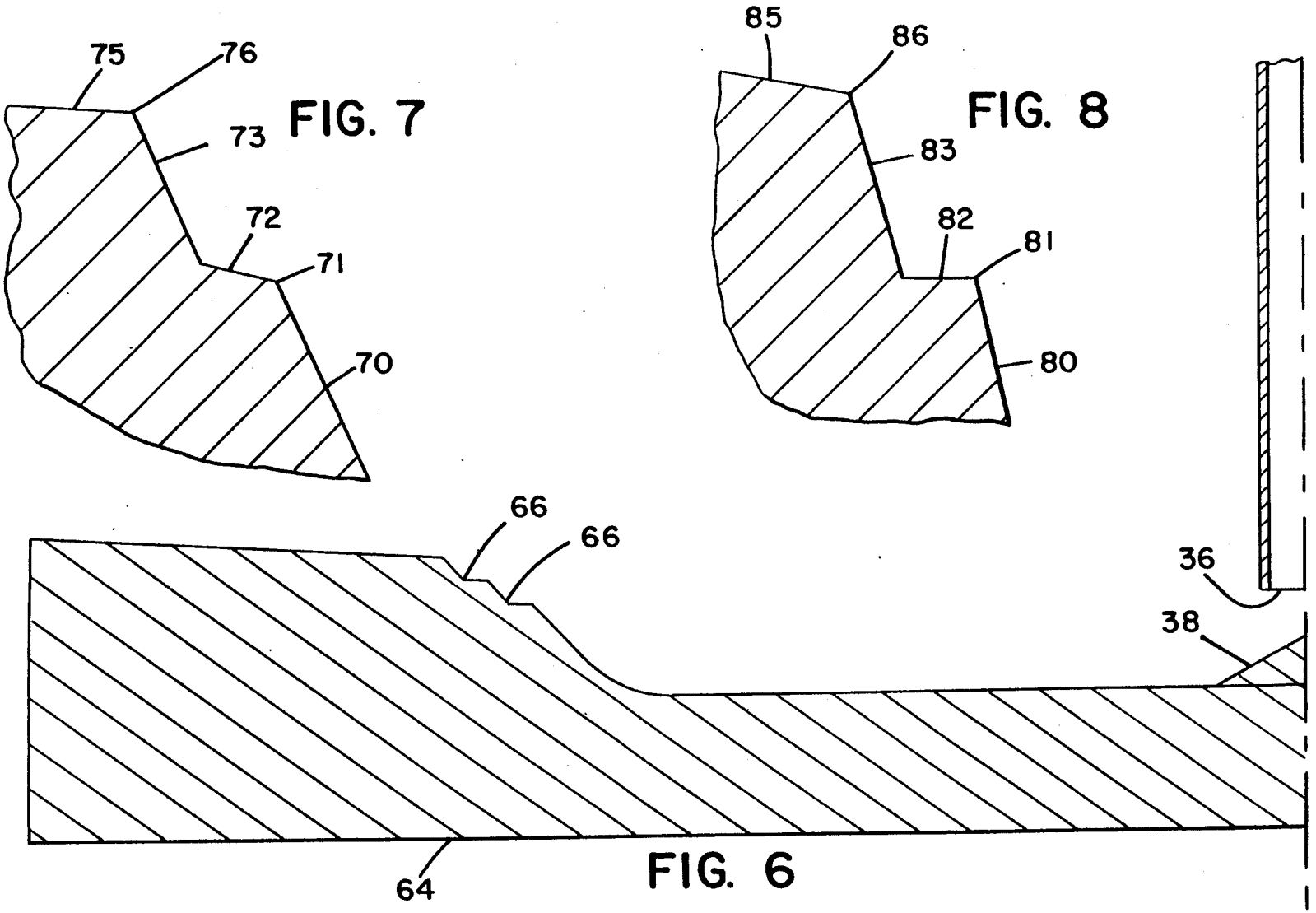
FIG. 6 is a radial cross-sectional view of an embodiment of a disk having two trips.
FIG. 7 is a cross-sectional view of a portion of a disk showing an alternative trip configuration.
FIG. 8 is a cross-sectional view of a portion of a disk showing a further alternative trip configuration.

If desired, a disk 64 as shown in FIG. 6 may be constructed with multiple trips 66 to enhance fractionation performance. In utilizing disks with two or more trips, the relative position of successive trips as well as the geometry of a particular trip will determine how effective the disk will be at fractionation of the slurry. The distance between trips should be small enough so that centrifugal migration of the larger fibers to the interior wall does not occur, yet large enough so that severe instabilities do not develop and cause chunks of the slurry containing large and small diameter fibers to be thrown off the disk. If a situation of severe film instability is created, the larger diameter fibers will be contaminated with the smaller diameter fibers and, also, the stream containing mainly small diameter particles will have a greater number of large fibers. For two trips with widths of 1/32 of an inch, an intertrip distance of ⅛ of an inch is found to result in good fractionation, while 1/16 of an inch results in film instability at slurry flow rates in excess of about 40 pounds mass per minute for a 6 inch diameter disk rotating at about 3800 RPM.

Practical limits on the size of a disk and the length of the skirt are imposed because the film on the surfaces of the disk will become unstable as the film moves sufficiently far away from the axis of rotation, but a larger disk may be utilized in accordance with the present invention as compared with prior art disk designs.

A variety of alternative trip configurations are possible which will accomplish the desired objective. One alternative, shown in FIG. 7, has an inner wall 70 terminating in a lower trip edge 71. The trip has an outwardly extending portion 72 and an upwardly extending portion 73 which meets the skirt 75 at an upper trip edge 76. The outwardly extending portion 72 is oriented upwardly at an angle with respect to horizontal. The configuration of FIG. 8 has an inner wall 80 terminating in a trip edge 81, and a trip composed of an outwardly extending portion 82 and an upwardly extending portion 83 which meets the skirt 85 at an upper trip edge 86. The portion 82 is oriented downwardly with respect to the horizontal. Other configurations are possible and are within the scope of the present invention.

Figure 9:
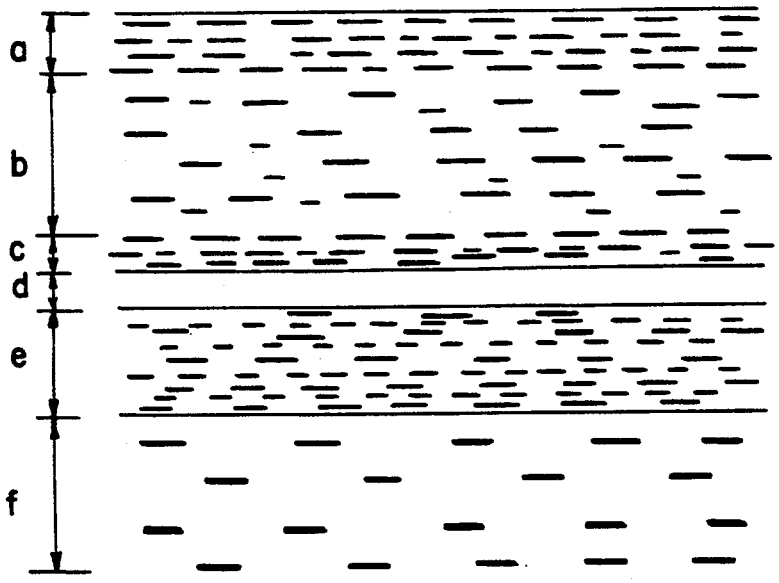
FIG. 9 is an illustrative view of a typical collection pattern for fractionated fibers on cloth located 5 cm from the disk periphery.

A typical collection pattern for the fractionated fibers in a slurry containing fibers of two sizes for a disk having a single trip is illustrated in FIG. 9 and consists of 3 bands. The quality and extent of separation can be determined by visual observation of the pattern and by measurement of the band widths, "a" through "f". These can be interpreted as follows:

| Band | Fiber Source |
|---|---|
| a | fibers ejected at lower trip edge |
| b | fibers ejected between trip and upper trip edge |
| c | fibers ejected from upper trip edge and part of skirt |
| d | gap between rejects and accepts at skirt level |
| e | smaller diameter fibers and larger ones that are carried over the upper trip edge |
| f | fibers ejected from radially outer portion of skirt and those that are carried over the peripheral edge of the skirt |

The top band consists predominatly of larger diameter fibers but may contain the smaller diameter fibers which may be ejected if film instabilities exist. The lower band consists mostly of smaller diameter fibers but can be contaminated with larger-diameter fibers not ejected upstream of the disk outer periphery.

In the examples below, fractionation with disks having varying dimensions and rotation speeds is illustrated.

EXAMPLES

Figure 10B:
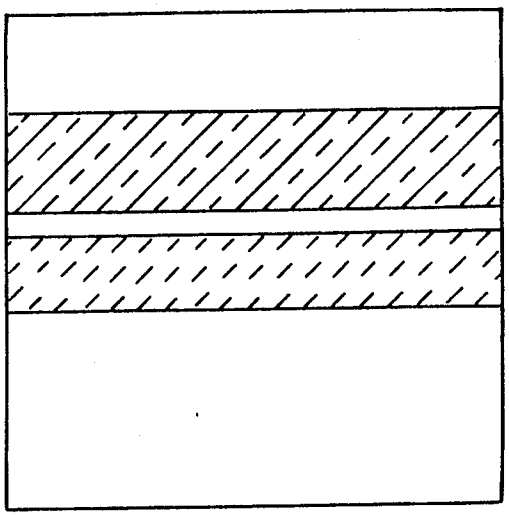
FIGS. 10(*a–d*) are schematic illustrations of the qualitative ratings of separation and cleanliness for the separations described in certain of the examples.
Figure 10D:
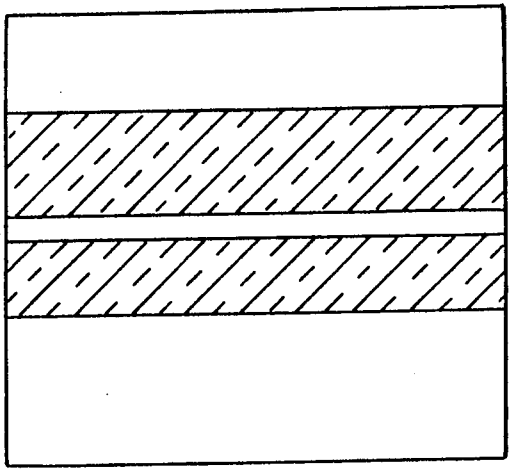
Figure 10A:
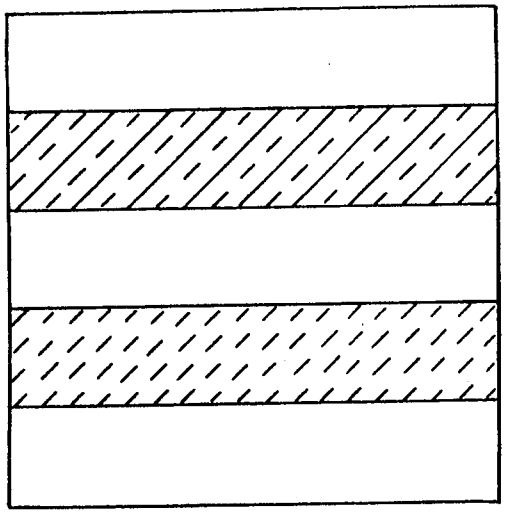
Figure 10C:
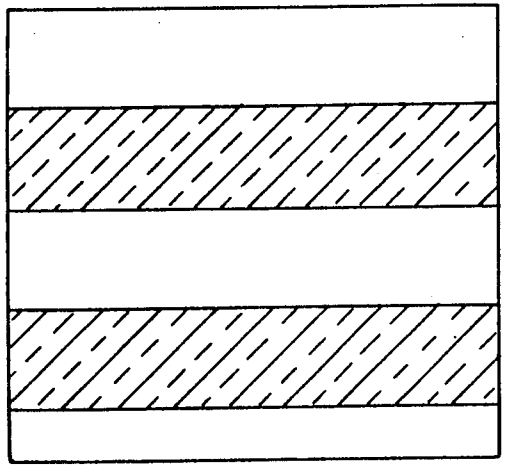

Fractionation was carried out with a feeding arrangement as illustrated in FIG. 1 on disks having varying geometries. The slurry for the test was made of rayon fibers of two different lengths and diameters. The small diameter fibers were 3 mm in length and 18 micrometers in diameter and were dyed red. The large fibers were 6 mm in length and 54 micrometers in diameter and were dyed black. The slurry was made up of equal weights of large and small diameter fibers with 50 grams of each type of fiber added to 75 gallons of water. The disks were tested at varying rotational speeds and slurry flow rates. The effectiveness of fractionation was judged on a relative scale. Referring to FIGS. 10(*a–d*), where the band having alternating solid and broken lines represents the top band (a, b, and c) of FIG. 9 and the band with broken lines alone represents the lower bands (e and f) of FIG. 9, separation of the two streams of particles ejected was rated from 0–10, with 0 being no separation of the streams and 10 being essentially perfect separation. Poorer separation of the two streams of particles ejected from the disk is illustrated in FIGS. 10*b* and *d;* good separation of the streams is illustrated in FIGS. 10*a* and *c*. Cleanliness was also rated on a scale of 1–10 with a high rating indicating very little mixing of large and small diameter fibers. Good cleanliness is shown at FIGS. 10*a* and *b;* poorer cleaniness is illustrated at FIGS. 10*c* and *d*.

Table 1 contains results of a test of a bowl-type disk 22.2 cm in diameter having a inner wall inclined at 45 degrees to a horizontal skirt 3 cm wide and having a radius of curvature of 1.9 cm at the intersection of the floor and inclined inner wall.

TABLE 1

BOWL-TYPE DISK (NO TRIP, SHARP EDGES)

| FLOW LB-M/MIN | SPEED RPM | SEPARATION (1–10) | CLEANLINESS (1–10) TOP/BOTTOM |
|---|---|---|---|
| 7.9 | 3800 | 2 | 2/3 |
| 11.5 | 4040 | 3 | 3/3 |
| 15.5 | 3800 | 4 | 3/3 |
| 28.7 | 3800 | 4 | 3/3 |

The dimensions of the disks which were tested with the results shown in tables 2–11 are the same as those of the disk in Table 1 except as noted.

Table 2 shows results from a bowl-type disk with a 1/16" by 1/16" inch trip with very sharp trip edges. Table 3 shows results from testing a disk with a single 1/16" by 1/16" inch trip with slightly rounded trip edges. The results show that when the trip edges are too sharp, film instability results and fractionation effectiveness suffers.

TABLE 2

BOWL-TYPE DISK (1/16" × 1/16" TRIP, VERY SHARP)

| FLOW LB-M/MIN | SPEED RPM | SEPARATION (1–10) | CLEANLINESS (1–10) TOP/BOTTOM |
|---|---|---|---|
| 11.3 | 4120 | 2 | 2/3 |
| 11.8 | 4080 | 2 | 2/3 |
| 11.8 | 3680 | 1 | 1/1 |
| 15.5 | 4080 | 2 | 2/4 |
| 28.2 | 3880 | 3 | 2/5 |
| 21.6 | 4000 | 2 | 2/4 |

TABLE 3

BOWL-TYPE DISK (1/16" × 1/16" TRIP, SLIGHTLY ROUNDED)

| FLOW LB-M/MIN | SPEED RPM | SEPARATION (1–10) | CLEANLINESS (1–10) TOP/BOTTOM |
|---|---|---|---|
| 11.3 | 4020 | 3 | 4/4 |
| 7.9 | 3920 | 3 | 6/3 |
| 11.7 | 4000 | 3 | 4/4 |
| 14.2 | 4000 | 3 | 4/5 |
| 28.7 | 3720 | 3 | 5/6 |

The results in table 4 are from testing of a disk with a ⅛" by 1/16" inch trip with slightly rounded trip edges. The disk tested in Table 5 has a trip with dimensions of 1/16"×1/32". The disk in Table 6 has a trip with dimensions of ⅛"×1/32" which has better performance than the disk of Table 5, but not as good performance as the disk of Table 4. The disk of Table 7 has a trip 3/16"×1/32". The disk of Table 8 has a trip of 3/16"×1/16" with improving fractionation.

TABLE 4

BOWL-TYPE DISK (⅛" × 1/16" TRIP, SLIGHTLY ROUNDED)

| FLOW LB-M/MIN | SPEED RPM | SEPARATION (1–10) | CLEANLINESS (1–10) TOP/BOTTOM |
|---|---|---|---|
| 7.6 | 3920 | 5 | 3/4 |
| 11.8 | 3880 | 5 | 4/4 |
| 15.6 | 3680 | 5 | 5/5 |
| 21.3 | 3860 | 5 | 4/6 |
| 29.3 | 3720 | 4 | 4/5 |
| 36.6 | 3760 | 3 | 3/3 |

TABLE 5

BOWL-TYPE DISK (1/16" × 1/32" TRIP, SLIGHTLY ROUNDED)

| FLOW LB-M/MIN | SPEED RPM | SEPARATION (1–10) | CLEANLINESS (1–10) TOP/BOTTOM |
|---|---|---|---|
| 11.5 | 3780 | 3.5 | 2/4 |
| 15.5 | 3760 | 4 | 2/4 |
| 21.2 | 3760 | 4.5 | 3/4.5 |
| 32.4 | 4000 | 4 | 3/4.5 |
| 28.7 | 3800 | 4.5 | 3/4.5 |

TABLE 6

BOWL-TYPE DISK (⅛" × 1/32" TRIP, SLIGHTLY ROUNDED)

| FLOW LB-M/MIN | SPEED RPM | SEPARATION (1–10) | CLEANLINESS (1–10) TOP/BOTTOM |
|---|---|---|---|
| 11.5 | 3740 | 4 | 3.5/4 |
| 15.4 | 3740 | 4.5 | 3.5/5 |
| 28.7 | 3800 | 5 | 3/5 |
| 32.1 | 3740 | 4.5 | 3/5 |
| 32.5 | 3740 | 4.5 | 2.5/4 |

TABLE 7

BOWL-TYPE DISK (3/16" × 1/32" TRIP, SLIGHTLY ROUNDED)

| FLOW LB-M/MIN | SPEED RPM | SEPARATION (1–10) | CLEANLINESS (1–10) TOP/BOTTOM |
|---|---|---|---|
| 11.3 | 3660 | 4.5 | 4/5 |
| 15.5 | 3760 | 4 | 4/4 |
| 21.1 | 3840 | 4.5 | 4/4 |
| 28.7 | 3740 | 5 | 3.5/5 |
| 32.4 | 3680 | 5 | 4/5 |
| 37.8 | 3600 | 5 | 4/4 |

TABLE 8

BOWL-TYPE DISK (3/16" × 1/16" TRIP, SLIGHTLY ROUNDED)

| FLOW LB-M/MIN | SPEED RPM | SEPARATION (1–10) | CLEANLINESS (1–10) TOP/BOTTOM |
|---|---|---|---|
| 11.3 | 3780 | 4.5 | 5/4 |
| 15.5 | 3740 | 5 | 5/4 |
| 28.9 | 3700 | 5 | 5/4 |
| 32.7 | 3700 | 4.5 | 4/4 |

The results in Table 9 are from the test of a disk with a single 1/16" by 1/32" inch trip with a 5 degree raised skirt.

TABLE 9

BOWL-TYPE DISK (1/16" × 1/32" SINGLE TRIP, SLIGHTLY ROUNDED EDGES) (5 DEGREE RAISED SKIRT)

| FLOW LB-M/MIN | SPEED RPM | SEPARATION (1-10) | CLEANLINESS (1-10) TOP/BOTTOM |
|---|---|---|---|
| 11.4 | 3860 | 5 | 5.5/5 |
| 28.7 | 3840 | 5 | 5.5/5 |
| 32.2 | 3800 | 5 | 5/5 |
| 34.4 | 3860 | 5 | 5/5 |

Table 10 shows results from tests of a disk with two trips having dimensions of 1/16"×1/16" and ⅛"×1/16". Table 11 shows results from tests of a disk with two trips having dimensions of 1/16"×1/32" and ⅛"×1/32" with a 5 degree raised skirt.

TABLE 10

BOWL-TYPE DISK (1/16" × 1/16" and ⅛" × 1/16" DOUBLE TRIP, SLIGHTLY ROUNDED)

| FLOW LB-M/MIN | SPEED RPM | SEPARATION (1-10) | CLEANLINESS (1-10) TOP/BOTTOM |
|---|---|---|---|
| 11.4 | 3840 | 5.5 | 6/6 |
| 15.5 | 3800 | 6 | 6/5 |
| 15.5 | 3620 | 6 | 6/5 |
| 28.5 | 3720 | 5.5 | 5/5 |
| 32.5 | 3700 | 5.5 | 5/5 |
| 32.2 | 3600 | 5 | 4.5/5 |
| 34.7 | 3660 | 5 | 5/5.5 |

TABLE 11

BOWL-TYPE DISK (1/16" × 1/32" AND ⅛" × 1/32" DOUBLE TRIP, SLIGHTLY ROUNDED EDGES) (5 DEGREE RAISED SKIRT).

| FLOW LB-M/MIN | SPEED RPM | SEPARATION (1-10) | CLEANLINESS (1-10) TOP/BOTTOM |
|---|---|---|---|
| 32.2 | 3560 | 4 | 4/4 |
| 11.4 | 3880 | 7.5 | 7/7 |
| 28.7 | 3840 | 7 | 7/6.5 |
| 32.7 | 3720 | 7 | 6.5/6 |
| 34.4 | 3800 | 6.5 | 6/6 |
| 11.4 | 3860 | 7 | 6/6 |
| 28.7 | 3760 | 6.5 | 6/6.5 |
| 32.4 | 3760 | 6 | 6/5 |
| 34.4 | 3800 | 6 | 6/5 |

Figure 11:
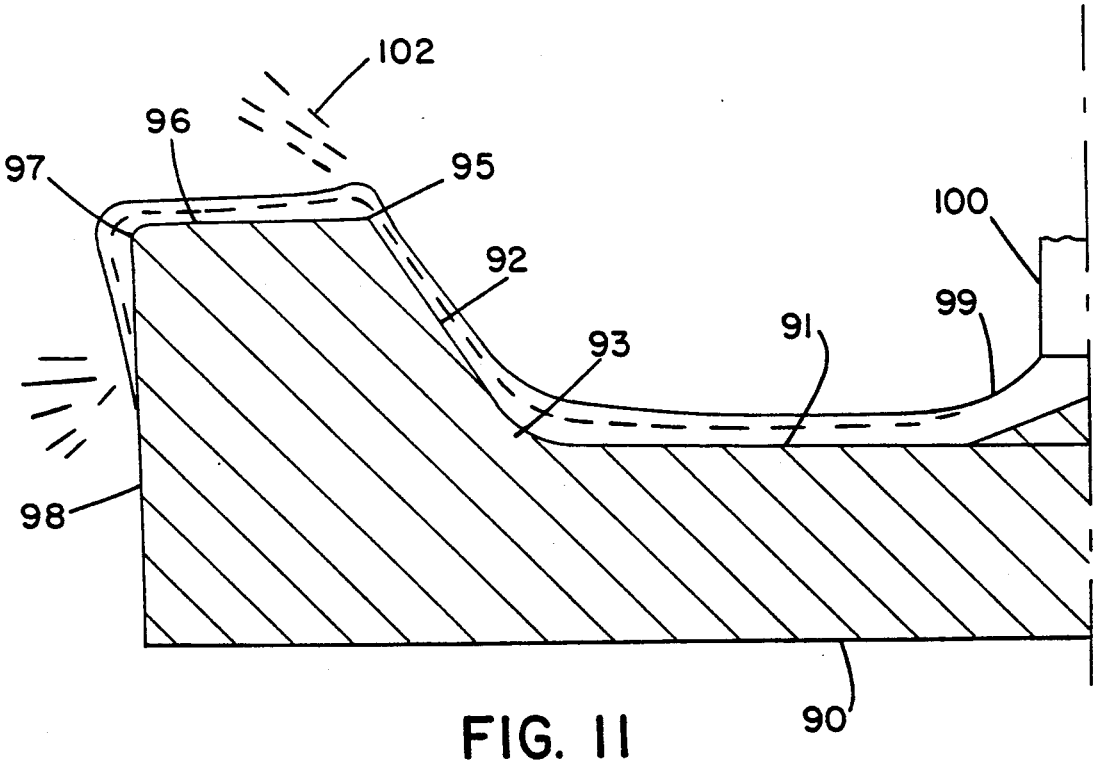
FIG. 11 is a radial cross-sectional view of another embodiment of a disk without a trip.

An embodiment of the separator disk without a trip is shown in partial cross section in FIG. 11 at 90. The disk 90 has a disk body with a planar floor 91, an inner wall 92 which joins the floor in a radiused curved portion 93, an axially symmetric peripheral edge 95 bounding the inner wall 92, an outwardly extending skirt 96, a skirt edge 97, and a rim 98 which descends from the skirt edge. Slurry 99 flows from a pipe 100 onto the floor of the disk and, when it turns over the peripheral edge 95, larger, substantially dewatered fibers 102 are ejected in a stream. The rest of the liquid and the smaller particles eject from the skirt peripheral edge 97 or from the rim.

The performance of disks of the form of FIG. 11 was investigated. The specifications were inner radius of floor, $R_1$, of 5.2 cm, radius of curvature (curve 93), $R_2$, of 1.9 cm, wall angle, $\theta$, of 45 deg. and two depths (distance from skirt 96 to floor 91), H, of 2.0 and 1.6 cm.

A dilute slurry of rayon fiber having 54 m diameters and 0.6 cm lengths was used as the test system. Samples of the ejected fibers were collected on cheese cloth pads located 12 in. from the disk's outer periphery and the extent of detachment was evaluated. Collection times were chosen to ensure that the total amount of slurry fed to the disk was the same for every test. Three situations were investigated: (i) the deep bowl design, H=2.6 cm with a clean disk wall, (ii) the deep bowl design, H=2.6 cm, with the disk wall rendered non-wetting or hydrophobic with polytetrafluoroethylene (PTFE) to reduce fiber drag, and (iii) the shallow bowl design, H=1.6 cm, with a clean disk inside wall. The results, which are summarized in Table 12, indicate little improvement in fiber ejection when the disk wall was rendered hydrophobic with polytetrafluorethylene (PTFE). A dramatic increase in the fraction ejected at the disk lip was noted for the shallow bowl design. However, the size of this fraction still was not large enough to achieve satisfactory classification, and the quality of fractionation was considered acceptable only at low throughputs of about 6.9 L/min or less. At higher feed rates the carry-over fraction contained large diameter fibers.

TABLE 12

Effect of lateral film migration on fractionation. (Disk diameter - 16 cm, $R_1$ = 5.2 cm, $R_2$ = 1.9 cm, $\theta$ = 45 deg. Fiber diameter = 54 μm, fiber length = 0.6 cm).

| Disk Depth cm | Rotation Speed, rev/min | Slurry Flow Rate, L/min | Fraction of Fibers Ejected++ |
|---|---|---|---|
| 1.6 | 3,940 | 4.6 | 0.75 |
| 1.6 | 3,840 | 6.9 | 0.60 |
| 1.6 | 3,700 | 10.3 | 0.55 |
| 1.6+ | 3,820 | 7.3 | 0.60 |
| 2.6+ | 3,450 | 6.1 | 0.30 |
| 2.6 | 3,480 | 5.2 | 0.25 |
| 2.6 | 3,160 | 9.3 | 0.10 |

+PTFE coating on disk wall.
++Obtained by visual observation of samples collected on cheese cloth pads.

Secondary flow, as illustrated in FIG. 4, because of the trip may occur. Although it is expected to have some influence, its effect on the fiber motion and, hence, fractionation is not readily determinable. The performance of disks with single trips was compared with that of the same disk without a trip. A dilute slurry of rayon fibers having 54 μm in. diameter and 0.6 cm length was used for test purposes. Samples of the ejected fibers were collected on cheese cloth pads located 12 in. from the disk outer periphery and the extent of detachment was evaluated. The results are summarized in Table 13 and suggest an increase in the fraction of fibers ejected when small trips are incorporated at the disk edge.

TABLE 13

Comparison of disk performance with and without film-trip (Disk diameter - 16 cm, $R_1$ = 1.9 cm, H = 1.6 cm, $\theta$ = 45 deg., fiber diameter = 54 μm, fiber length = 0.6 cm)

| Trip dimensions in (L × W) | Disk Speed rev/min | Slurry rate L/min | Fraction of fibers ejected at disk lip |
|---|---|---|---|
| No Trip | 3,940 | 10.1 | 0.75 |
| | 3,840 | 15.2 | 0.60 |
| | 3,700 | 22.8 | 0.55 |
| ¼ × 1/16 | 3,950 | 11.5 | 0.70 |
| | 3,450 | 16.1 | 0.77 |
| | 3,790 | 25.8 | 0.73 |
| 1/16 × 1/16 | 3,840 | 17.5 | 0.80 |
| | 3,900 | 23.8 | 0.80 |

The importance of the trip width, W, on the fiber motion is illustrated in FIGS. 4 and 5. The trip effectiveness can be enhanced by keeping the width small. If W is about equal to fiber length, the fibers are more likely to remain close to the wall, while if W is very small, say W equals about 10 times the fiber diameter, the fibers will disengage themselves from the wall as shown in FIG. 5. Experiments, the results of which are summarized in Table 14, were performed with disks having $R_1=5.5$ cm, $\theta=45$ deg., rotational speed at 3,800 rev/min, Q=11–40 lbm/min, to fractionate rayon fibers having L=6 mm, $d_p=54$ μm and $\rho_p=1.5$ g/cu-cm. Trips having widths of 1/16 and 1/32 in. were found to be effective in disengaging these fibers from the slurry film, with the latter being a better choice.

The trip length, L, also determines how effective the trip can be. It has been found that L should be less than the maximum fiber migration distance, h. The predicted maximum fiber migration distance for the conditions specified in Table 14 is 3 mm or half a fiber length. Consequently, a deterioration in the trip effectiveness is expected for $\frac{1}{8}\times 1/32$ and $\frac{3}{8}\times 1/32$ in. trips. It may be noted that the larger fibers detached themselves from the liquid film both at the trip lower edge and along the ejection zone on the skirt extending radially outward from the trip upper edge approximately 1–2 cm.

TABLE 14

Effect of film-trip length on fiber migration. (16 cm diameter disk with a 45 deg. lip angle, Trip width = 1/32 in., fiber sizes = 54 μm, 6 mm and 18 μm, 3 mm)

| Trip length in | Disk speed rev/min | Surry rate L/min | Trip effectiveness |
|---|---|---|---|
| 1/16 | 4,000 | 32.4 | good |
| $\frac{1}{8}$ | 4,000 | 32.4 | good |
| 3/16 | 3,680 | 32.4 | fair |
| $\frac{3}{8}$ | 3,700 | 32.7 | poor |

The conditions required for fractionation of fibers which differ in diameter or wettability can be summarized in accordance with the embodiments of the invention set forth above. The surface of the disk in contact with the film of slurry must be highly wettable by the slurry liquid. Also, the face surface of the disk must be large enough such that sufficient momentum is provided to fibers at the trip edges and at the ejection zone to allow escape of some of the fibers to occur. Furthermore, the trip edges must be sharp enough to facilitate fiber disengagement yet round enough to preclude film instability. The effect of centrifugal fiber migration is minimized by ensuring that the disk inside radius at the intersection between the floor and the inner wall is sufficiently large and that the bowl is relatively shallow. Fiber migration is further reduced by incorporating single or multiple trips into the design. Trip widths are preferably small, about 1/32 of an inch, and trip lengths are preferably no more than half a fiber length. Intertrip lengths should be small enough to preclude fiber migration, yet not so small as to create film instability. The surfaces of the disk should be adapted to form a stable film of the slurry thereon. Other surface characteristics may be provided to the face and rim to best stabilize slurry film in accordance with fluid mechanics practice.

Fiber fractionation or separation occurs at the trip edges and at the ejection zone on the skirt of the disk. Fibers which possess enough kinetic energy to overcome surface forces are disengaged from the film whereas those which do not possess enough kinetic energy are trapped within the film and carried to the edge of the skirt or to the rim. The spray emanating from the disk is, under preferred conditions, composed of two separate zones: one containing large diameter, substantially dewatered fibers and relatively unwettable fibers which are able to disengage from the liquid film, and the other containing small fibers and most of the liquid which is disengaged only from the outer skirt edge, the rim surface and the rim edge. The fractions are preferably collected very close to the disk surface to avoid overlap of those zones.

It should be apparent that, while the above described fractionations were carried out with fiber slurries, similar separation can be obtained with various types of homogeneous or heterogeneous slurries of solid particles, including agglomerates and fibriles, and in accordance with differences in particle wettability as well as size.

Although the fractionation apparatus preferably employs a slurry feed directed downwardly onto a fractionation disk, effective fractionation may also be obtained with a slurry feed directed upwardly onto an inverted fractionation disk.

While specific embodiments of the invention have been disclosed and described herein, the invention is not so limited, but rather embraces such modified forms thereof that come within the scope of the following claims.

What is claimed is:

1. A fractionation disk for use in spray fractionation apparatus, comprising a disk body which is symmetric about an axis of rotation having:

(a) a planar floor;

(b) an inner inclined wall extending upwardly from the perimeter of the floor, the wall terminating in an axially symmetric lower trip edge;

(c) an axially symmetric trip, extending from the lower trip edge, with an outwardly extending portion and an upwardly extending portion, the trip terminating in an upper trip edge; and (d) a skirt extending from the upper edge of the trip terminating at a peripheral edge wherein the floor, inner inclined wall, trip, and skirt are wettable and adapted to allow a stable film of a particle carrying liquid to form thereon.

2. The fractionation disk of claim 1 wherein the skirt extends substantially horizontally from the upper edge of the trip.

3. The fractionation disk of claim 1 wherein the skirt is inclined upwardly from the horizontal as it extends from the upper edge of the trip.

4. The fractionation disk of claim 3 wherein the skirt is inclined upwardly at an angle of about 5 degrees from the horizontal.

5. The fractionation disk of claim 1 wherein the inner inclined wall joins the perimeter of the planar floor with a smooth curve.

6. The fractionation disk of claim 1 wherein the upwardly extending portion of the trip is inclined.

7. The fractionation disk of claim 1 further comprising:

a second axially symmetric trip located below the first trip, the second trip having an outwardly extending portion and an upwardly extending portion, the second trip terminating in an upper trip edge which forms the lower trip edge of the first trip 8. The fractionation disk of claim 7 wherein the upwardly extending portions of the trips are inclined.

9. The fractionation disk of claim 1 further including a cone formed on the center of the disk floor onto which slurry may be flowed.

10. Apparatus adapted for fractionating a mixture of particles of different sizes suspended in liquid to produce at least two portions of particles, comprising:

(a) a wettable fractionation disk having a disk body which is symmetric about an axis of rotation with a planar floor, an inner inclined wall extending upwardly from the perimeter of the floor, the wall terminating in an axially symmetric lower trip edge, an axially symmetric trip with an outwardly extending portion and an upwardly extending portion, the trip terminating in an upper trip edge, and a skirt extending from the upper trip edge and terminating at a peripheral edge;

(b) means for rotating the disk about its axis of rotation;

(c) a supply outlet mounted such that a mixture of particles in suspension in a liquid can be supplied therethrough onto the floor of the disk; and (d) a separator wall having an inner edge located closely adjacent to the skirt of the disk at a position which is intermediate the upper trip edge and the peripheral edge of the skirt to physically separate first and second streams of material ejected from the disk so that they do not substantially mix.

11. The apparatus of claim 10 wherein the skirt extends substantially horizontally from the upper edge of the trip.

12. The apparatus of claim 10 wherein the skirt is inclined upwardly from the horizontal as it extends from the upper edge of the trip.

13. The apparatus of claim 12 wherein the skirt is inclined upwardly at an angle of about 5 degrees from the horizontal.

14. The apparatus of claim 10 wherein the upwardly extending portion of the trip is inclined.

15. The apparatus of claim 10 wherein the inner inclined wall joins the perimeter of the planar floor with a smooth curve.

16. The apparatus of claim 10 further comprising:

a second axially symmetric trip located below the first trip, the second trip having an outwardly extending portion and an upwardly extending portion, the second trip terminating in an upper trip edge which forms the lower trip edge of the first trip.

17. The apparatus of claim 16 wherein the upwardly extending portions of the trips are inclined.

18. The apparatus of claim 10 further including a cone formed on the center of the disk floor onto which slurry may be flowed from the supply outlet.

19. A fractionation disk for use in spray fractionation apparatus comprising a disk body which is symmetric about an axis of rotation having:

(a) a planar floor;

(b) an inner inclined wall extending upwardly from the perimeter of the floor, the wall terminating in an axially symmetric edge;

(c) a skirt extending outwardly substantially horizontally from the edge and terminating at a peripheral edge, wherein the skirt is inclined upwardly from the horizontal as it extends from the edge of the wall; and (d) a rim descending from the peripheral edge of the skirt, wherein the floor, inner inclined wall, and skirt are wettable and adapted to allow a stable film of a particle carrying liquid to form thereon.

20. The disk of claim 19 wherein the skirt is inclined upwardly at an angle of about 5 degrees from the horizontal.

21. A fractionation disk for use in spray fractionation apparatus comprising a disk body which is symmetric about an axis of rotation having:

(a) a planar floor;

(b) an inner inclined wall extending upwardly from the perimeter of the floor, the wall terminating in an axially symmetric edge, further including an axially symmetric trip formed in the inner wall, the trip having a portion which extends outwardly from a lower trip edge and an upwardly extending portion, the trip terminating in an upper trip edge;

(c) a skirt extending outwardly substantially horizontally from the edge and terminating at a peripheral edge; and (d) a rim descending from the peripheral edge of the skirt, wherein the floor, inner inclined wall, and skirt are wettable and adapted to allow a stable film of a particle carrying liquid to form thereon.

22. The disk of claim 21 wherein the upwardly extending portion of the trip is inclined.

23. The disk of claim 21 further including a second axially symmetric trip located below the first trip, the second trip having an outwardly extending portion and an upwardly extending portion, the second trip terminating in an upper trip edge which forms the lower edge of the first trip.

24. The disk of claim 23 wherein the upwardly extending portions of the trips are inclined.

25. Apparatus adapted for fractionating a mixture of particles of different sizes suspended in liquid to produce at least two portions of particles, comprising:

(a) a wettable fractionation disk having a disk body which is symmetric about an axis of rotation with a planar floor, an inner inclined wall extending upwardly from the perimeter of the floor, the wall terminating in an axially symmetric upper edge, a skirt extending outwardly substantially horizontally from the edge and terminating at a peripheral edge of the skirt;

(b) means for rotating the disk about is axis of rotation;

(c) a supply outlet mounted such that a mixture of particles in suspension in a liquid can be supplied therethrough onto the floor of the disk; and (d) a separator wall having an inner edge closely adjacent to the skirt of the disk at a position intermediate the upper edge of the inner wall and the peripheral edge of the skirt to physically separate first and second streams of material ejected from the disk so that they do not substantially mix.

26. The apparatus of claim 25 wherein the skirt is inclined upwardly from the horizontal as it extends from the edge of the wall.

27. The apparatus of claim 26 wherein the skirt is inclined upwardly at an angle of about 5 degrees from the horizontal.

28. The apparatus of claim 25 wherein the inner inclined wall joins the perimeter of the planar floor with a smooth curve.

29. The apparatus of claim 25 further including a cone formed on the center of the disk floor onto which slurry may be flowed from the supply outlet.

30. The apparatus of claim 25 further including an axially symmetric trip formed in the inner wall, the trip having a portion which extends outwardly from a lower trip edge and an upwardly extending portion, the trip terminating in an upper trip edge.

31. The apparatus of claim 30 wherein the upwardly extending portion of the trip is inclined.

32. The apparatus of claim 30 further including a second axially symmetric trip located below the first trip, the second trip having an outwardly extending portion and an upwardly extending portion, the second trip terminating in an upper trip edge which forms the lower edge of the first trip.

33. The apparatus of claim 32 wherein the upwardly extending portions of the trips are inclined.

34. A method of separating particles from a mixture of particles which are suspended in a liquid, comprising the steps of:

(a) providing an axially symmetric disk having a body with a planar floor, an inner inclined wall extending upwardly from the perimeter of the floor, the wall terminating in an axially symmetric lower trip edge, an axially symmetric trip having an outwardly extending portion and an upwardly extending portion, the trip terminating in an upper trip edge, a skirt extending outwardly from the upper edge of the trip terminating at a peripheral edge, wherein the floor, inner inclined wall, trip and skirt are wettable and adapted to allow a stable film of particle carrying liquid to form thereon;

(b) rotating the disk about its axis of symmetry;

(c) supplying a suspension of particles in liquid to the floor of the disk, the suspension containing a mixture of particles;

(d) selecting the speed of rotation of the disk and selecting the rate of flow of the liquid suspension to the floor such that a stable film of the liquid suspension is formed on the disk; and (e) collecting the material that is discharged from the region of the upper trip edge of the disk and separately collecting the material that is discharged from the region of the skirt of the disk.

35. The method of claim 34 wherein the step of collecting the material discharged from the disk includes interposing a separator wall between the stream of material discharged from the upper edge of the trip and the material discharged from the skirt of the disk to physically separate the streams.

* * * * *

UNITED STATES PATENT AND TRADEMARK OFFICE

CERTIFICATE OF CORRECTION

PATENT NO. : 5,104,522

DATED : April 14, 1992

INVENTOR(S) : Edwin J. Crosby; Rustam H. Sethna; Anil R. Oroskar

It is certified that error appears in the above-identified patent and that said Letters Patent is hereby corrected as shown below:

Column 14, line 68, "trip" should be --trip.--.

Column 16, line 48, "is" should be --its--.

Signed and Sealed this

Fifteenth Day of June, 1993

*Attest:*

Michael K. Kirk

MICHAEL K. KIRK

*Attesting Officer*

*Acting Commissioner of Patents and Trademarks*